US008580168B1

(12) United States Patent
Steiner

(10) Patent No.: US 8,580,168 B1
(45) Date of Patent: Nov. 12, 2013

(54) SYSTEM AND METHOD TO ACCOUNT FOR THERMAL DIE EXPANSION

(75) Inventor: Michael R. Steiner, New Bremon, OH (US)

(73) Assignee: Honda Motor Co., Ltd., Tokyo (JP)

( * ) Notice: Subject to any disclaimer, the term of this patent is extended or adjusted under 35 U.S.C. 154(b) by 807 days.

(21) Appl. No.: 12/725,058

(22) Filed: Mar. 16, 2010

(51) Int. Cl.
*B29C 45/80* (2006.01)

(52) U.S. Cl.
USPC ..... 264/40.5; 425/150

(58) Field of Classification Search
USPC ..... 425/150; 264/40.1, 40.5
See application file for complete search history.

(56) References Cited

U.S. PATENT DOCUMENTS

| | | | | |
|---|---|---|---|---|
| 3,534,442 | A * | 10/1970 | Mahle | 425/170 |
| 3,579,741 | A * | 5/1971 | Schwartz | 425/149 |
| 4,256,166 | A * | 3/1981 | Prince | 164/303 |
| 4,716,952 | A * | 1/1988 | Hegel et al. | 164/303 |
| 4,832,884 | A * | 5/1989 | Speck et al. | 264/40.5 |
| 4,880,792 | A | 11/1989 | Yoshioka et al. | |
| 5,059,365 | A * | 10/1991 | Hertzer et al. | 264/40.5 |
| 5,365,998 | A * | 11/1994 | Stummer | 164/154.1 |
| 5,863,474 | A | 1/1999 | Ito et al. | |
| 6,050,804 | A * | 4/2000 | Tamaki et al. | 425/190 |
| 6,589,456 | B1 * | 7/2003 | Maru et al. | 264/40.5 |
| 6,595,766 | B2 * | 7/2003 | Nakamoto | 425/149 |
| 6,821,104 | B2 | 11/2004 | Kubota et al. | |
| 7,179,409 | B2 | 2/2007 | Nishino | |
| 7,287,972 | B2 | 10/2007 | Tsuji et al. | |
| 7,288,221 | B2 | 10/2007 | Tsuji et al. | |
| 7,494,609 | B2 | 2/2009 | Tsuji et al. | |
| 7,566,214 | B2 | 7/2009 | Koike et al. | |
| 8,097,192 | B2 * | 1/2012 | Tsuda et al. | 264/40.5 |
| 2003/0145975 | A1 | 8/2003 | Katoh et al. | |
| 2003/0147988 | A1 * | 8/2003 | Miyauchi et al. | 425/589 |
| 2009/0026645 | A1 | 1/2009 | Tsuda et al. | |
| 2009/0261496 | A1 | 10/2009 | Koike et al. | |

FOREIGN PATENT DOCUMENTS

| | | | |
|---|---|---|---|
| JP | 4-197721 | * | 7/1992 |
| JP | 5-309707 | A | 11/1993 |
| JP | 8-52776 | A | 2/1996 |
| JP | 11-348043 | * | 12/1999 |

OTHER PUBLICATIONS

Machine translation of JP 11-348043, undated.*

* cited by examiner

*Primary Examiner* — James Mackey
(74) *Attorney, Agent, or Firm* — Standley Law Group LLP

(57) ABSTRACT

A system and method for effecting die height adjustments of a casting machine, such as to account for thermal die expansion. The system and method finds use on a die casting machine having a driven gear train for causing linear movement of a movable platen thereof. Based on known characteristics of the gears of the gear train and of threaded tie bar nuts upon which the gear train operates, a given rotation of a gear train gear can be converted into a linear movement of the movable platen. A sensor is used to count the teeth of a rotating gear train gear and a controller is provided to correlate the tooth count with a corresponding linear travel distance of the movable platen.

19 Claims, 2 Drawing Sheets

FIG−1

SYSTEM AND METHOD TO ACCOUNT FOR THERMAL DIE EXPANSION

TECHNICAL FIELD

The invention described herein relates to a system and method for performing automatic die height adjustments. More specifically, the invention described herein relates to a system and method that permits a casting machine to compensate for thermal die expansion.

BACKGROUND

A die casting machine generally comprises a stationary platen and a movable platen. The stationary platen is fitted with a stationary die half. The movable platen is fitted with a movable die half. The movable platen is aligned with the stationary platen by tie bars. The movable platen can be advanced toward and away from the stationary die along these tie bars. Movement of the movable platen toward and away from the stationary platen during machine operation may be accomplished by hydraulic cylinder, a toggle clamping linkage, etc., as would be familiar to one of skill in the art.

A problem associated with die casting processes is thermal expansion of a casting die. Thermal die expansion is a phenomenon that is well known in the die casting art and, therefore, need not be explained in detail herein. Generally, however, the repeated formation of work pieces by the introduction of molten metal into a casting die increases the die temperature and leads to the thermal expansion thereof. While the extent of this thermal expansion may not seem significant from a purely dimensional standpoint, the die growth can nonetheless be sufficient to negatively affect or interfere with proper casting machine operation. More specifically, after die expansion, the previously set clamping position of the movable platen may result in excessive pressure on the casting die, which can lead to excessive force being exerted on the die, increased strain on the tie bars, and/or other problems.

Therefore, it is known to adjust the position of a movable platen to account for thermal die expansion, a process commonly referred to as making a die height adjustment (or something similar thereto). On most casting machines, a manual die height adjustment may be performed by a machine operator. Manual adjustment often consists of a trial and error movement of the movable platen to what is believed to be a proper clamping location. This is time consuming and performed outside full automatic operation of the die casting machine.

Newer die casting machines may offer automatic die height adjustment systems that are able to automatically compensate for thermal die expansion. However, such an automated feature was not generally available on older die casting machines. While it is sometimes possible to retrofit such a system to an older die casting machine, doing so is typically a costly option that must be purchased from the original equipment manufacturer. Known automated die height adjustment systems available from the various original equipment manufacturers are generally quite complex, utilizing encoders, linear scales, specialized controllers and specialized programming. Further, the electrical components of the original casting machines become obsolete, frequently requiring that they also be upgraded, redesigned or modified in order to accommodate a retrofit die height adjustment system. This also adds cost to such a retrofit.

Consequently, it can be understood from the forgoing discussion that it would be desirable to provide a system and method for inexpensively and simply performing an automatic die height adjustment so as to compensate for thermal die expansion. Preferably, such a system may be easily retrofit to an existing die casting machine. A system and method of the present invention has such capabilities.

SUMMARY OF THE GENERAL INVENTIVE CONCEPT

An exemplary embodiment of the inventive system and method of the present invention may be used with a die casting machine having a drive motor and gear train affixed to the rear face of the movable platen for making small adjustments to the position of the movable platen. The gear train includes an input gear associated with the drive motor and a series of idler gears in intermeshed communication so as to translate rotational motion imparted by the drive motor to a tie bar nut of the die casting machine. The idler gears have a known number of teeth, a known pitch, etc. Similarly, the tie bar nut and a threaded portion of the associated die casting machine tie bar to which the tie bar nut is threaded, also have a known pitch.

To determine the distance of travel of the movable platen a sensor (e.g., a proximity switch) is provided to monitor rotation of a gear in the gear train, such as an idler gear. As the idler gear rotates, the proximity switch counts the number of passing teeth. Based on a given tooth count and on information such as the idler gear circular pitch and/or diameter, and a known relationship between rotation of the idler gear and rotation of the tie bar nut, the linear distance traveled by the movable platen per a given tooth count can be calculated. Since linear movement of the movable platen can be calculated from the tooth count of a rotating idler gear, this simple tooth count can be used to control an automatic die height adjustment process.

As described in more detail below, a system and method that controls automatic die height adjustment by calculating the linear travel distance of a movable platen from the rotational motion of an idler gear, allows for the easy and cost effective retrofitting of existing die casting machines while eliminating the need for complex and expensive original equipment manufacturer systems. Therefore, a system and method of the present invention overcomes the deficiencies of existing automatic die height adjustment systems and methods known to the inventor.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
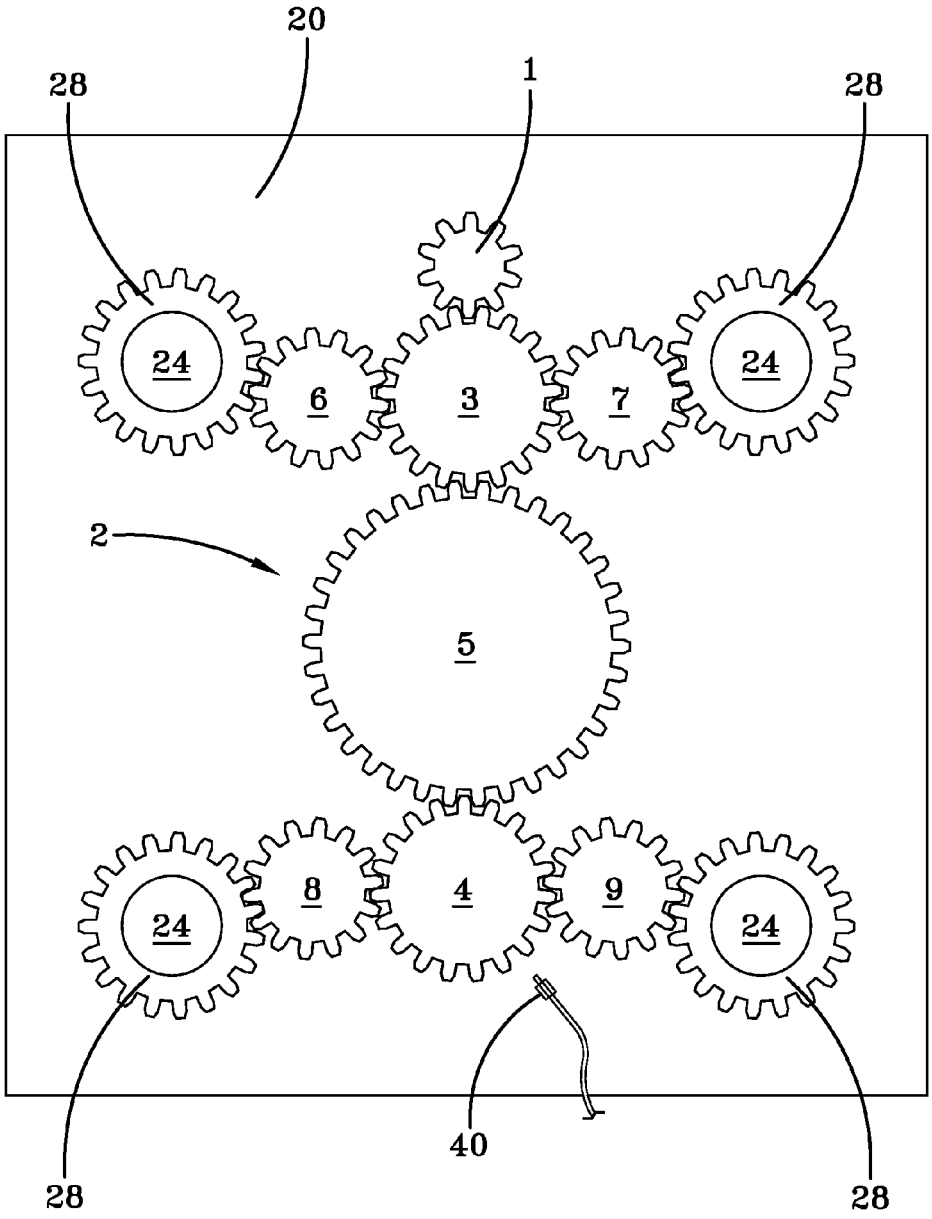
FIG. 1 depicts a sensor portion of an exemplary embodiment of a system of the present invention associated with an exemplary die casting machine movable platen, the platen including a driven gear train for effecting fine linear movements of the movable platen.
Figure 2:
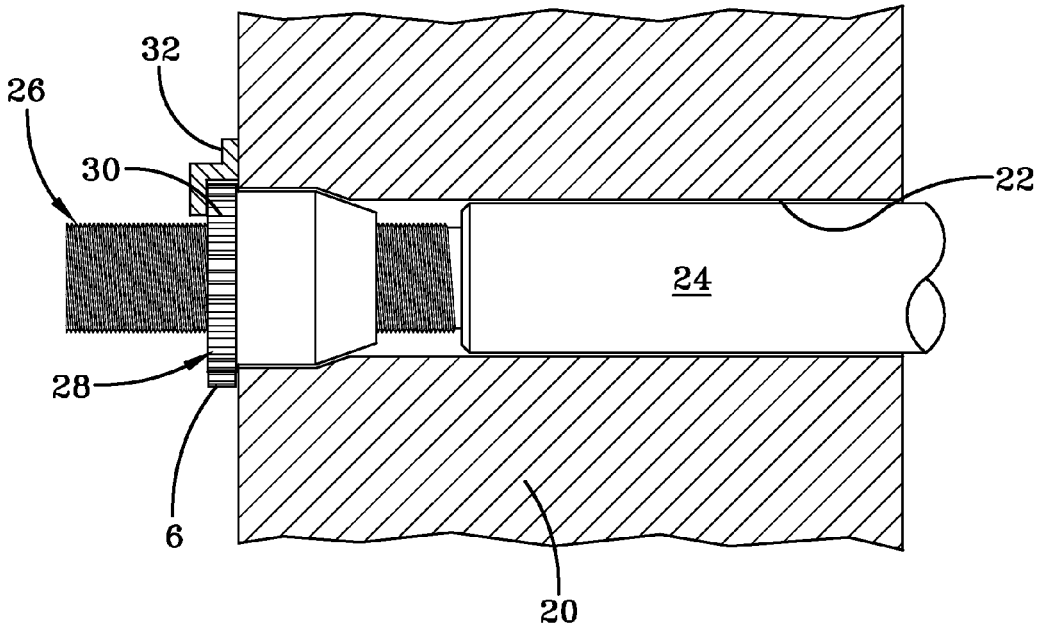
FIG. 2 is a cutaway side view of a portion of the exemplary movable platen of FIG. 1, and related components associated therewith.

A movable platen and various related components of an exemplary die casting machine that may benefit from the system and method described herein is illustrated in FIG. 1 and FIG. 2. As shown, the die casting machine includes a movable platen 20, which moves along a plurality of tie bars 24, and a gear train 2 of rotatable clears that is associated with a non-die side of the movable platen. A drive motor/input gear 1 is provided to rotationally drive the gear train, which also includes a series of intermeshed idler gears 3-9 that are rotatably affixed to the back of the movable platen 20.

More specifically, the gear train 2 of this exemplary die casting machine includes a central idler gear 5 located substantially equidistantly between the plurality of tie bars 24 that pass through the movable platen 20, a second pair of idler gears 3, 4 that are intermeshed with and located on opposite sides of the central idler gear and substantially in line with a rotational axis thereof, a toothed tie bar nut 28 that is associated with each tie bar, and an idler gear 6, 7, 8, 9 that is disposed between and intermeshed with a respective one of the gears of the second pair of idler gears and a corresponding one of the tie bar nuts. The drive motor/input gear 1 is intermeshed with one of the rotatable gears. Each idler gear 3-9 has a known number of teeth. The arrangement of the idler gears 3-9 allows for the rotational motion imparted to the input gear 3 by the drive motor/input gear 1 to be transferred to the tie bar nuts 28 associated with the tie bars 24 of the die casting machine (as is described in more detail below).

In the exemplary casting machine shown in FIG. 1 and FIG. 2, the rotational motion of the gear train 2 is used to impart linear motion to the movable platen 20 via the mechanism shown in FIG. 2. More specifically, the movable platen 20 receives one end of each tie bar 24 in a bore 22 that passes through the tie bar. An opposite end of each tie bar 24 is fixed, such as to the stationary platen (not shown in the Figures) of the die casting machine.

The end of the tie bar 24 passing through the movable platen 20 has a threaded portion 26 with a measureable and known thread pitch. A tie bar nut 28 is threaded over the threaded portion 26 of the tie bar 24 so as to abut the gear train side of the movable platen 20. Each tie bar nut 28 includes an exposed cogged portion 30 having teeth that complimentarily mesh with the teeth of idler gears 6, 7, 8, 9 of the gear train 2. The remaining portion of each tie bar nut 28 extends into the bore 22. The tie bar nuts 28 are held in place by a nut retainer 32 affixed to the back of the movable platen 20. The nut retainers 32 ensure that the movable platen 20 moves linearly along the tie bars 24 when the tie bar nuts 28 are rotated by the gear train 2.

As the drive motor/input gear 1 rotates the gear train 2, the gears 6, 7, 8, 9 thereof impart rotational motion to the corresponding tie bar nuts 28. As the tie bar nuts 28 rotate, they travel linearly along the tie bar 24 due to their threaded engagement therewith. The direction of the linear travel of the tie bar nuts 28 along the longitudinal length of the tie bars 24 is dependent on the direction of the rotational motion of the drive motor. As the tie bar nuts 28 are coupled to the movable platen 20 by the nut retainers 32, the movable platen 20 also moves linearly by the same distance and in the same direction.

To determine the extent of linear movement of the movable platen 20 on casting machines having a gear train like or similar to the gear train 2 shown in FIGS. 1-2, a sensor 40 may be used to count gear teeth as one of the gears rotates. As shown in FIG. 1, a sensor 40 in the form of a proximity switch is used to count the teeth of the bottom-middle idler gear 4 as it rotates. The sensor 40 may be attached to the movable platen 20 or may be mounted to other structure that allows for proper location of the sensor near a gear of choice. Although the sensor 40 is shown interfacing a particular idler gear 4 in this particular embodiment, it should be understood by those skilled in the art that the sensor could instead be associated with the drive motor/input gear 1 or another idler gear 3, 5-9 of the gear train 2.

The sensor 40 counts the number of teeth on the idler gear 4 that pass the sensor as the idler gear rotates. A tooth count may be sent to a controller for control of an automatic die height adjustment operation. In order for the controller to make use of the tooth count, the tooth count must be converted into a linear travel distance of the movable platen 20. This conversion may be accomplished through calculations based on the idler gear 4 tooth spacing, circular pitch, etc., and the tie bar 24 thread pitch. The precise calculations may vary, but as would be understood by one of skill in the art, a given tooth count (rotation of the idler gear 4) can be correlated to a given amount of linear travel of the tie bar nuts 28 and movable platen 20. For example only, a tooth count of 10 may equal a 0.1 inch linear displacement of the movable platen 20.

As would also be well known to one of skill in the art, various systems and techniques are available to alert an operator or otherwise determine that a die height adjustment is necessary. For example, sensors may be provided to measure clamping or locking force, tie bar strain, or other similar die and/or machine conditions. Signals from these sensors may be provided to a processor (controller) and an associated software program that can use the signals to determine if a die height adjustment is necessary and, if so, how much of a die height adjustment is necessary. For example, a given amount of increased clamping force or tie bar strain may be correlated to a need for a given amount of die height adjustment, etc.

Once it is determined that a die height adjustment is necessary, the adjustment may be made manually or automatically according to the present invention. In a manual embodiment or a manual mode, the need for a die height adjustment can be determined as described above, and an operator may be alerted accordingly such as by an audible or visual alarm, etc. The operator may then, if desired, perform a visual inspection of the die to confirm there is no flash formation or an alternative reason for the alarm. After such inspection, or when ready absent an inspection, the operator may then engage a die height adjustment actuator, which actuates a die height adjustment routine operative to adjust the linear position of the movable platen.

During the die height adjustment process, the controller and program utilizes a tooth count signal received from the sensor 40 to determine and control rotation of the drive motor/input gear 1 and, thereby, the amount of linear movement of the movable platen 20. Once the tooth count signal from the sensor 40 reaches a value commensurate with a calculated necessary amount of movable platen linear travel, the controller deactivates the drive motor such that the movable platen remains in an adjusted position.

In an alternative automatic embodiment or an automatic mode, the need for a die height adjustment can be determined as described above, and a required die height adjustment may be made without operator intervention and/or operator notification. The actual movable platen positional adjustment process may function in substantially the same manner in the automatic mode as in the above-described manual mode. However, in the automatic mode, the process may be initiated without assistance from an operator. For example, after a given number of repeated cycles with a sensor reading outside of some predetermined limit (e.g., overpressure, excess strain), an automatic die height adjustment may be automatically initiated by the controller.

The present invention represents an effective alternative to the expensive and possibly unavailable retrofit die height adjustment systems currently available. Further, although a system and method have been described herein as being particularly applicable to retrofit die casting machine applications, it should be apparent that a system and method of the present invention may also be applied to any molding machine, existing or newly manufactured, wherein given rotation of a gear or similar element can be correlated with a given amount of linear platen movement.

Therefore, while certain embodiments of the present invention are described in detail above, the scope of the invention is not to be considered limited by such disclosure, and modifications are possible without departing from the spirit of the invention as evidenced by the following claims:

The invention claimed is:

1. A system for controlling the linear movement of a molding machine movable platen, comprising:

a driven gear train of rotatable gears associated with the movable platen of said molding machine, said rotatable gears including a central idler gear located substantially equidistantly between a plurality of tie bars passing through said movable platen, a second pair of idler gears intermeshed with and located on opposite sides of said central idler gear and substantially in line with a rotational axis thereof, a toothed tie bar nut associated with each tie bar, an idler gear disposed between and intermeshed with one of said gears of said second pair of idler gears and one of said tie bar nuts, and a drive gear intermeshed with one of said rotatable gears, said gear train adapted to impart linear motion to said movable platen when said rotatable gears are rotated;

a sensor to count the teeth of a selected rotatable gear during the rotation thereof; and a controller in communication with said sensor, said controller programmed to convert a tooth count received from said sensor into a linear travel distance of said movable platen and to use said tooth count to monitor and control a subsequent linear movement of said molding machine movable platen.

2. The system of claim 1, wherein said controller converts said tooth count received from said sensor into said linear travel distance of said movable platen by correlating an amount of gear rotation associated with a given tooth count to an amount of tie bar nut rotation.

3. The system of claim 2, wherein tie bar nut rotation is converted into said linear travel distance using the thread pitch of the tie bar nut.

4. The system of claim 1 wherein said sensor is a proximity sensor.

5. A system for accounting for thermal die expansion, comprising:

a first sensor to detect a predetermined condition of a molding machine;

a driven gear train of rotatable gears associated with a movable platen of said molding machine, said rotatable gears including a central idler gear located substantially equidistantly between a plurality of tie bars passing through said movable platen, a second pair of idler gears intermeshed with and located on opposite sides of said central idler gear and substantially in line with a rotational axis thereof, a toothed tie bar nut associated with each tie bar, an idler gear disposed between and intermeshed with one of said gears of said second pair of idler gears and one of said tie bar nuts, and a drive gear intermeshed with one of said rotatable gears, said gear train adapted to impart linear motion to said movable platen when said rotatable gears are rotated;

a second sensor to count the teeth of a selected rotatable gear during the rotation thereof; and a controller in communication with said first and second sensors, said controller programmed to convert a tooth count received from said second sensor into a linear travel distance of said movable platen;

wherein, said first sensor is adapted to signal said controller that a die height adjustment is required when said first sensor detects that said predetermined condition of said molding machine is outside of an acceptable range; and wherein said controller is adapted to use a tooth count signal received from said second sensor to monitor and control a subsequent linear movement of said molding machine movable platen.

6. The system of claim 5, wherein said driven gear train associated with said movable platen of said molding machine is operative to rotate said tie bar nut of each threaded tie bar of said molding machine, rotation of said tie bar nuts causing a linear movement of said movable platen.

7. The system of claim 6, wherein said controller converts said tooth count received from said second sensor into said linear travel distance of said movable platen by correlating an amount of gear rotation associated with a given tooth count to an amount of tie bar nut rotation.

8. The system of claim 7, wherein tie bar nut rotation is converted into said linear travel distance using the thread pitch of the tie bar nut.

9. The system of claim 5, wherein said first sensor is selected from the group consisting of a strain gauge and a pressure transducer.

10. The system of claim 5, wherein said second sensor is a proximity sensor.

11. A system for accounting for the thermal expansion of a casting die located within a die casting machine, comprising:

a die casting machine having a stationary platen and a movable platen, said movable platen movable toward and away from said stationary platen along a path defined by a plurality of tie bars;

an end of each tie bar extending from said movable platen having a threaded section;

a toothed tie bar nut threaded to the threaded section of each tie bar, each tie bar nut coupled to said movable platen;

a driven gear train of rotatable gears associated with said movable platen of said die casting machine, said rotatable gears including a central idler gear located substantially equidistantly between said tie bars, a second pair of idler gears intermeshed with and located on opposite sides of said central idler gear and substantially in line with a rotational axis thereof, an idler gear disposed between and intermeshed with one of said gears of said second pair of idler gears and one of said tie bar nuts, and a drive gear intermeshed with one of said rotatable gears, said gear train adapted to impart linear motion to said movable platen by rotating said tie bar nuts when said rotatable gears are rotated by a drive motor associated with said drive gear, which causes said tie bar nuts and said movable platen to advance toward or away from said stationary platen along the length of said tie bars;

a first sensor to detect a predetermined condition of said die casting machine;

a second sensor to count the teeth of a selected rotatable gear during the rotation thereof; and a controller in communication with said first and second sensors, said controller associated with software programmed to determine when a signal from said first sensor indicates the need for a die height adjustment, to determine from said signal an amount of movable platen linear travel required in accordance with said die height adjustment, to convert a tooth count received from said second sensor into a linear travel distance of said movable platen, and to use said tooth count to monitor a subsequent linear movement of said die casting machine movable platen and to control said linear movement of said die casting machine movable platen by controlling rotation of said drive motor.

12. The system of claim 11, wherein said controller converts said tooth count received from said second sensor into said linear travel distance of said movable platen by correlating an amount of gear rotation associated with a given tooth count to an amount of tie bar nut rotation.

13. The system of claim 12, wherein tie bar nut rotation is converted into said linear travel distance using the thread pitch of the tie bar nut.

14. The system of claim 11, wherein said first sensor is selected from the group consisting of a strain gauge and a pressure transducer.

15. The system of claim 11, wherein said second sensor is a proximity sensor.

16. A method for automatically adjusting the die height of a die casting machine to account for thermal expansion of a casting die mounted therein, said die casting machine having a stationary platen and a movable platen, said movable platen being movable toward and away from said stationary platen along a path defined by a plurality of tie bars, an end of each tie bar extending from said movable platen having a threaded section with a toothed tie bar nut threaded thereto, each tie bar nut also coupled to said movable platen, said method comprising:

associating a driven gear train assembly of toothed rotatable gears with said movable platen of said die casting machine, said gear train assembly including a central idler gear located substantially equidistantly between said plurality of tie bars, a second pair of idler gears intermeshed with and located on opposite sides of said central idler gear and substantially in line with a rotational axis thereof, an idler gear disposed between and intermeshed with one of said gears of said second pair of idler gears and one of said tie bar nuts, and a drive gear intermeshed with one of said rotatable gears, said gear train assembly adapted to engage and rotate said tie bar nuts when said rotatable gears are rotated by a drive motor so as to impart linear motion to said movable platen, and a tooth counting sensor adapted to count the teeth of a selected rotatable gear during the rotation thereof;

sensing a predetermined condition of said die casting machine with a first sensor;

providing a controller and associated program for controlling a die height adjustment operation;

transmitting a signal from said first sensor to said controller, said signal used by said controller and said program to determine the need for a die height adjustment and, if such an adjustment is needed, to determine an amount of movable platen linear travel required in accordance with said die height adjustment;

alerting an operator when a die height adjustment is needed;

activating said drive motor associated with said gear train assembly of said die casting machine;

transmitting a tooth count from said tooth counting sensor to said controller, said tooth count converted by said controller and said program into a linear travel distance of said movable platen by correlating an amount of gear rotation associated with a given tooth count to an amount of tie bar nut rotation, and converting said tie bar nut rotation into said linear travel distance of said movable platen by using the thread pitch of the tie bar nuts; and using said controller to monitor the resulting linear movement of said die casting machine movable platen by analyzing said tooth count and to control and terminate said linear movement of said die casting machine movable platen by controlling rotation of said drive motor of said gear train assembly and halting rotation of said drive motor when the tooth count transmitted by said tooth counting sensor equals a tooth count calculated by said controller as being required to result in a desired amount of movable platen linear travel.

17. The method of claim 16, further comprising engaging an actuator that signals said controller to initiate a die height adjustment operation.

18. The method of claim 16, wherein said first sensor is selected from the group consisting of a strain gauge and a pressure transducer.

19. The method of claim 16, wherein the teeth of a selected rotatable gear of said die casting machine gear train assembly are counted using a proximity sensor.

* * * * *